United States Patent [19]

Colognori

[11] Patent Number: 4,475,836

[45] Date of Patent: Oct. 9, 1984

[54] BACKSCRUBBER AND/OR BACKSCRATCHER WITH REMOVABLE SPONGE ELEMENT

[76] Inventor: Aldo Colognori, 69 Lawton Ave., Cliffside Park, N.J. 07010

[21] Appl. No.: 561,789

[22] Filed: Dec. 15, 1983

[51] Int. Cl.[3] ..... A47L 13/17

[52] U.S. Cl. ..... 401/201; 15/145; 15/244 R; 294/3; 294/99 R

[58] Field of Search ..... 15/244 R, 145, 244 A; 294/3, 16, 99 R; 401/201

[56] References Cited

U.S. PATENT DOCUMENTS

| | | | |
|---|---|---|---|
| 1,723,520 | 8/1929 | Pintel | 401/201 |
| 2,710,420 | 6/1955 | Granat et al. | 401/201 |
| 2,936,471 | 5/1960 | Coleman | 15/244 R X |
| 3,061,861 | 11/1962 | Hartmann | 15/244 R X |
| 3,787,919 | 1/1974 | Siemund | 15/244 R |

FOREIGN PATENT DOCUMENTS

| | | | |
|---|---|---|---|
| 657460 | 9/1951 | United Kingdom | 15/244 R |

*Primary Examiner*—Chris K. Moore
*Attorney, Agent, or Firm*—Ralph R. Roberts

[57] ABSTRACT

There is disclosed a device which is both a backscrubber and/or a backscratcher in which a sponge is utilized to provide the contacting member. A handle of conventional design is provided and a stem portion of wire or wire-like material extends therefrom. At a selected distance from this handle a pivot means is provided in this stem portion. Beyond this pivot means the end of the wire member is bent or formed into an arc-like configuration to provide one-half of a tong-like jaw. Another and like wire or wire-like member is pivotally retained and one end portion is compatibly formed to provide the other half of a tong-like jaw. The other end of this member is bent into a hook to provide a lock means for the jaws. A sponge is formed with a reduced midportion which is sized to be gripped and retained by the tong-like jaw ends. A sponge having a pocket for the insertion and retention of a soap bar is shown. Meshing means for retaining the tong-like jaw ends are also shown.

13 Claims, 12 Drawing Figures

15
18
16
20
14
4
4
22

11
20
14
10
12

15
18
16
20
22
14
12

218
215
216

20
22

115
118
116

34
30
32

BACKSCRUBBER AND/OR BACKSCRATCHER WITH REMOVABLE SPONGE ELEMENT

BACKGROUND OF THE INVENTION

1. Field of the Invention

This invention pertains to backscrubbers or backscratchers and particularly those with removable and replaceable pad elements.

2. Description of the Prior Art

Backscrubbers and backscratchers are well known and first appeared in China with bamboo formations which are still used and sold. Sponges are also well known and for personal scrubbing of pots, pans, hands, feet and the like are a convenient means for using soap in cake or liquid form. Backscrubbers that are known usually have the applicator portions fixedly secured to the handle means to establish a fixed relationship. The present invention provides an inexpensive construction of a backscrubber and/or backscratcher in which the sponge may be made of a rough and firm composition or may be softer for gentle use. In any construction the sponge is composed of a material that may be used with fluids such as water and may have an addition of soap such as liquid detergent.

SUMMARY OF THE INVENTION

This invention pertains to a device for personal use in which both a backscrubber and a backscratcher is present. This device allows personal manipulation to reach portions of the body such as a back and either scratch or apply soap and scrub. In the present illustration of this device a round sponge pad is depicted as having a reduced diameter central portion. This sponge portion is gripped by pivotally swung and latch retained tong ends of wire-like members. These tong ends are sized and adapted to grip the central portion of the sponge member and retain this sponge during use and operation. This device is inexpensive to manufacture and the sponge portion may be replaced or repaired without discarding the handle and tong portion. The sponge portion may be made in several sizes and thicknesses and degrees of coarseness or stiffness to be used as desired.

In addition to the above summary the following disclosure is detailed to insure adequacy and aid in understanding of the invention. This disclosure, however, is not intended to cover each new inventive concept no matter how it may later be disguised by variations in form or additions of further improvements. For this reason there has been chosen a specific embodiment of the backscrubber and/or backscratcher with removable sponge member as adopted for personal use and showing a preferred means for construction. This specific embodiment has been chosen for the purpose of illustration and description as shown in the accompanying drawing wherein:

BRIEF DESCRIPTION OF THE DRAWING

In the following description and in the claims various details are identified by specific names for convenience. These names are intended to be generic in their application. Corresponding reference characters refer to like members throughout the several figures of the drawing.

DESCRIPTION OF THE PREFERRED EMBODIMENT

Figures 1, 2, 3, 4, 5, 6, 7:
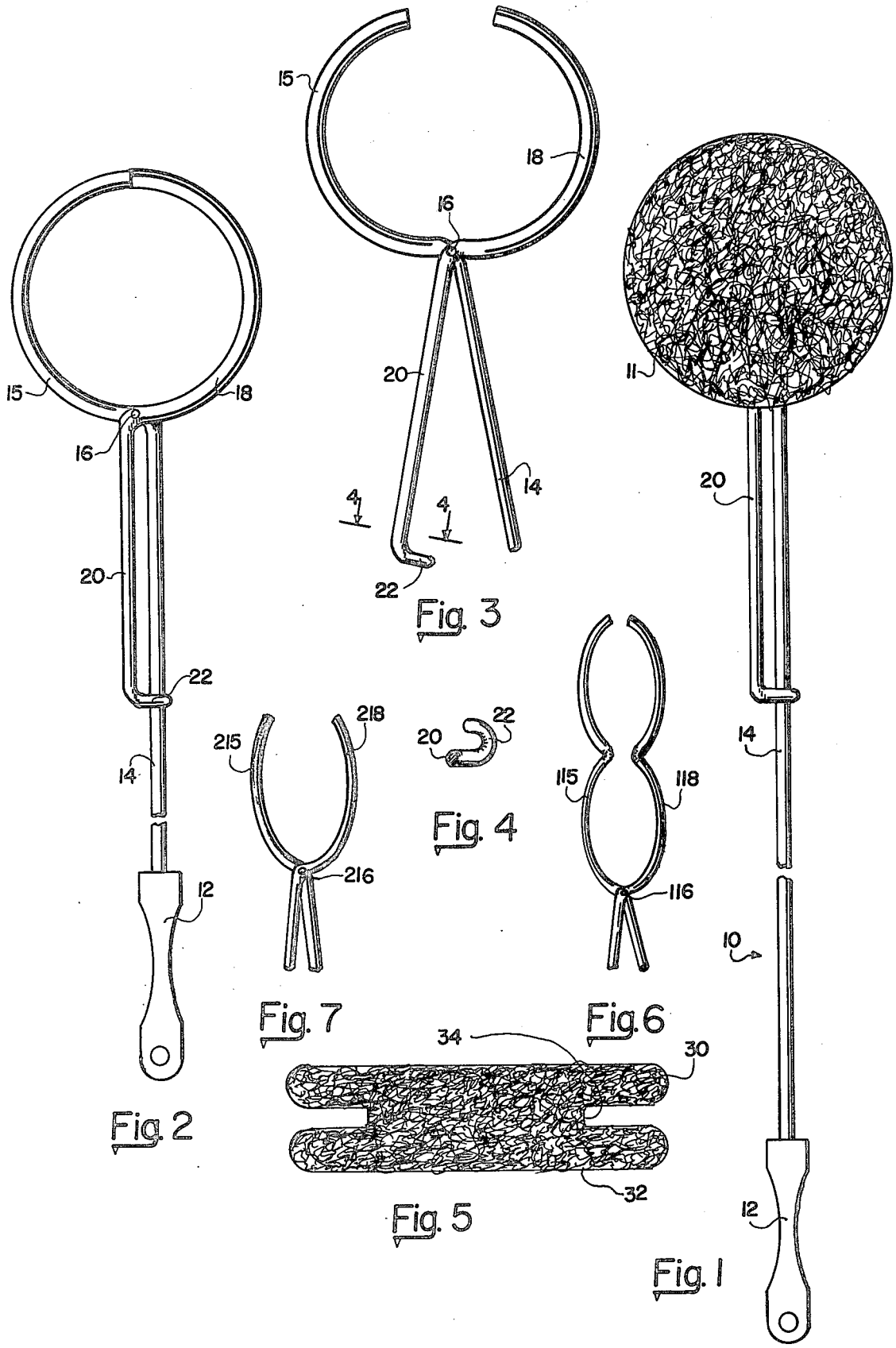
FIG. 1 represents a side view of the assembled device of this invention.
FIG. 2 represents a side view of the device of FIG. 1 absent a sponge member secured in the closed pivotally connected tong-like jaw members.
FIG. 3 represents a partly fragmentary view of the tong-like jaw members of FIG. 2 with the tong-like jaw members in an open condition.
FIG. 4 represents a sectional and plan view of the hook end of the swung tong-like jaw member, this view taken on the line 4—4 of FIG. 3 and looking in the direction of the arrows.
FIG. 5 represents a side view, partly diagrammatic and showing a sponge in a free state and before securing in the jaws of the device.
FIG. 6 represents, in a reduced scale, an alternate configuration of the tong ends, this configuration substantially indicating the tong-like ends forming a figure eight.
FIG. 7 represents yet another tong-like jaw configuration and in a reduced scale and with this configuration substantially indicating the tong-like jaw ends in an elliptical figure.

There is shown in the single sheet of drawing a backscrubber and/or backscratcher in which an assembled unit is identified as 10 and includes a sponge element 11 at one end of the device. At the other end and providing a handle for grasping and manipulation is a handle 12. This handle is contemplated as a molding of plastic and at the time of molding or in a tight hole there is a wire or thin rod-like portion 14 which extends more-or-less axially thereof. The upper end of this portion 14 is bent into an arcuate one-half circle 15 to form one jaw portion of a tong grip.

A pivot 16 is provided and may be a pin and the like and extends through a hole formed at the end of portion 14. A mating jaw portion 18 is formed in another length of wire and provides a semi-circle and with the other portion provides the mating tong portion. At the end of this semi-circular configuration 18 is formed a hole for the mounting therethrough of the pivot pin 16.

A short length of this wire or rod-like portion identified as 20 extends from this pivot hole to a hook retainer 22 formed by bending this distal end. Simple manipulation of the hook 22 allows retention engagement as in FIG. 2, and manipulation also provides release of the hook as shown in FIG. 3 whereat the tong grip is opened to allow insertion or disengagement of the sponge element 11.

In FIG. 4 the simple hook providing the releasable lock of the tong portions in a gripping condition is shown. The sponge generally identified as 10 is conventionally of a foamed plastic and as depicted is shown as round. Other shapes may be provided including square or rectangular.

In FIG. 5 is shown a side view of a sponge 11 as seen in FIG. 1. Each sponge includes outer members 30 and 32 which are adjacent and contiguous with a reduced intermediate portion 34 sized to be a snug compressed fit in the closed tong jaws 15 and 18 when the jaws are closed as in FIG. 2.

The sponge material is conventionally of foam plastic and the stiffness or density is selected to suit. This sponge 11 is conventionally not affected by water and/or soap used therewith. Replacement of said sponge 11 is easily achieved by manipulation. It is to be noted that the configuration of the sponge members is a matter of choice.

In FIG. 6 the tong-like jaw ends are shown in a reduced scale to indicate that the jaws may be formed in other than semi-circular patterns. As depicted, pivot 116 is provided and one tong-like jaw portion 115 is convoluted into one-half of a figure eight. The mating tong-like jaw portion is similarly convoluted and is identified as 118. The swung portion has a hook end as in FIG. 4. The sponge may have its reduced portion 34 shaped other than round or these tong-like jaw ends may be used with a sponge having a round configuration when and where the sponge is sufficiently resilient to be squeezed by the tong-like ends.

In FIG. 7 the tong-like jaw ends are shown in a reduced scale and to indicate that the jaw ends may be formed in a elliptical shape. As depicted, a pivot 216 is provided and one tong-like jaw portion 215 is convoluted into one-half of an ellipse. The mating tong-like jaw portion is similarly convoluted and is identified as 218. The swung portion has a hook end as in FIG. 4. The sponge 11 of FIG. 5 may have its intermediate portion shaped to suit these jaw ends. As in FIG. 6 where and when the sponge is sufficiently resilient the closing of these jaw ends secures the sponge in position.

The pivot 16, as shown, contemplates a pin secured in one member and with the pin providing a hinge for the swinging of the other tong-like jaw. Said pivot may be made in many other forms such as a hinge not using a scissor arrangement and pivot means is claimed to include the many pivot concepts known in the art.

The sponge 11 of FIG. 5 is shown as a molding of unitary construction but this is not to preclude the making of the sponge as an assembly using glue or other known assembly methods. By this means the sponge may have exterior portions of different thicknesses and consistancy. This may be desirable where the device is to be used for scrubbing with water and for scratching in a dry condition. The embodiments shown and described show the wire-like portions as round but this does not preclude the use of square, rectangular, elliptical and wire having flattened side portions. The corss section of this stem and companion tong-like jaw portion is merely a matter of selection.

Figure 8:
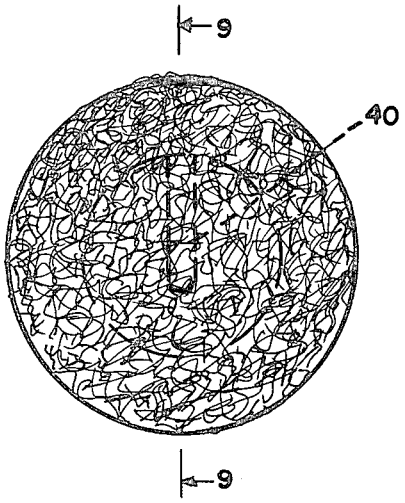
FIG. 8 represents a face view of an alternate sponge construction, this view partly diagrammatic to show a pocket for the placing therein of a small bar of soap.
Figure 9:
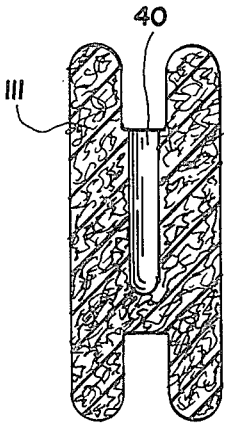
FIG. 9 represents a sectional side view of the sponge of FIG. 8, this view taken on the line 9—9 thereof and looking in the direction of the arrows.

EMBODIMENT OF FIGS. 8 and 9

The sponge of FIGS. 1 and 5 may be altered to provide for the securing of a soap member in a pocket formed therein. As depicted a sponge 111 is formed with a pocket or recess 40 which is conventionally an elongated pocket of a regular cross section which may be rectangular, oval or other configuration selected to suit. Whatever the form of the pocket it is contemplated that the tong-like jaws will be carried in the intermediate reduced portion to close the open end of the recess when the sponge is gripped for use. The pocket 40 is adapted to receive and retain elongated bars of soap in solid form but this pocket may also be used to receive a measured quantity of liquid soap or detergent.

EMBODIMENT OF FIG. 10

Figure 10:
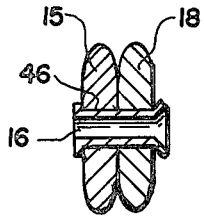
FIG. 10 represents a sectional view taken through the pivot means and showing the preferred constuction of the pivot.

FIG. 10 shows a pivot means adjacent the tong-like jaws which are slightly flattened to provide in the wire-like members flat areas 44 and 46 at their facing surfaces. The wire-like portions may also be flattened at their outer extents to allow punching or otherwise forming a through hole 48 for a pivot pin 16. This pivot pin may be a rivet, either hollow or solid and with the ends turned to form a retaining means. Rivets are conventionally provided with a head already formed and the other end with a tubular portion which is turned to provide a retaining shoulder. Hollow rivets are the least expensive and are well adapted for mass production processes.

Figure 11:
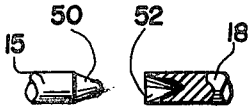
FIGS. 11 and 12 represent fragmentary sectional views showing proposed meshing means provided at the distal ends of the tong-like jaws of the device.
Figure 12:
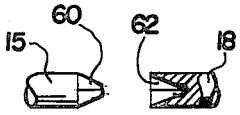

EMBODIMENT OF FIGS. 11 and 12

The distal ends of the tong-like jaws 15 and 18 may be formed to provide meshing and alignment means. In FIG. 11 the ends of the wire-like jaws are formed with male and female tapered pin and socket configurations. The male end has a protruding tapered pin portion 50 which is sized and shaped to mate and enter a like-shaped socket-like recess 52 formed at and in the end of the other tong-like jaw. In FIG. 12 the ends of the tong-like jaws are shown as swaged by a four-slide wire forming machine. The male end 60 is made with a three or four side configuration and a male shape. The end of the other tong-like jaw is made with a receiving socket 62 which is sized and shaped to mesh with the male end formed on the other jaw.

USE AND OPERATION

It is to be noted that the sponge of FIGS. 8 and 9 anticipates that either a liquid or solid soap be used. When and where the soap is solid in form the pocket 40 is employed and the soap member is positioned in this pocket. A mid-portion of one of the tong-like jaws is positioned over the entrance end of the pocket and when the jaws are secured by the clamp end 22 the solid soap member is secured in the pocket 40 during use of the device.

The forming of the distal ends of the tong-like jaws to provide a mesh arrangement enables the jaws to be retained in alignment during operational use. Sometimes a twisting force on one of the jaws may cause the jaws to tend to bend from alignment but a meshing construction of the ends prevents such a problem and insures the tong-like jaws in a determined alignment.

Terms such as "left", "right", "up", "down", "bottom", "top", "front", "back", "in", "out" and the like are applicable to the embodiments shown and described in conjunction with the drawing. These terms are merely for the purposes of description and do not necessarily apply to the position in which the backscrubber or backscratcher may be constructed or used.

While particular embodiments of the backscrubber and/or backscratcher have been shown and described it is to be understood the invention is not limited thereto and protection is sought to the broadest extent the prior art allows.

What is claimed is:

1. A device for scrubbing and/or scratching the back of a user and providing means for manipulation by said user to reach otherwise inaccessible areas of the body, said device including:

(a) a handle portion adapted for grasping by the user;
(b) a wire-like stem portion secured to and extending from said handle portion;
(c) a pivot means provided at a determined distance from said handle and on said wire-like stem portion;
(d) a tong-like jaw formed from the distal end portion of the wire-like stem portion, this tong-like jaw formed into a semi-circular configuration of a selected radius;
(e) a separate wire-like length member having a mid-portion adapted to engage and be retained by said pivot means so as to be rotated and swung about said pivot means;
(f) a tong-like jaw formed in the end portion of this separate wire-like length, said tong-like jaw formed into a semi-circular configuration with a radius similar to that in the complimentary jaw;
(g) a hook retaining configuration formed in and at the other end of the separate wire-like length member and adapted to engage and be removably retained by said stem portion, and
(h) a sponge formed from resilient material of a selected softness and having a reduced intermediate portion configured and sized so as to provide and be gripped when and while the tong-like jaw portions are in a closed and retained condition.

2. A device as in claim 1 in which the pivot means is a pin and with said pin providing a pivot for the movable jaw member.

3. A device as in claim 1 in which the sponge is formed with a pocket which extends into the internal portion of the sponge and the open end of this pocket is positioned in the reduced intermediate portion.

4. A device as in claim 3 in which the pocket is of a regular cross section and is adapted to receive a solid bar of soap and the tong-like jaws are sized and configured so that in a closed sponge retaining condition an intermediate portion of one of said tong-like jaws is caused to come in way of the open end of the pocket and block said open end to a dislodgement of the inserted bar of soap.

5. A device as in claim 1 in which the pivot means includes a rivet having at least one end adapted to be formed into an enlarged portion and the wire-like portions adjacent the tong-like jaws are flattened at least at their facing surfaces and in these flattened areas of the wire-like portions there is a hole in each portion sufficient for the insertion of the rivet and the swaging of the end of the rivet is sufficient to retain the tong-like jaws.

6. A device as in claim 1 in which the tong-like jaws have their distal ends formed to provide a mesh retaining engagement when the jaws are brought together in a closed and clamped condition.

7. A device as in claim 6 in which the distal ends are formed to provide a male tapered end on one jaw and a compatibly formed female socket on the other jaw end.

8. A device as in claim 7 in which the male shape is a cone and the female socket is a compatibly tapered recess.

9. A device as in claim 7 in which the male shape is a plural tapered form and the female socket is shaped with protruding portions.

10. A device as in claim 1 in which the sponge has a circular configuration with larger outer portions of substantially the same diameter.

11. A device as in claim 1 in which the handle is a molding and is fixedly secured to the stem portion.

12. A device for scrubbing and/or scratching the back of a user and providing means for manipulation by said user to reach otherwise inaccessible areas of the body, said device including:
(a) a handle portion adapted for grasping by the user;
(b) a wire-like stem portion secured to and extending from said handle portion;
(c) a pivot means providing at a determined distance from said handle and on said wire-like stem portion;
(d) a tong-like jaw formed from the distal end portion of the wire-like stem portion, this tong-like jaw formed into one-half of a figure eight configuration selected radii;
(e) a separate wire-like length member having a mid-portion adapted to engage and be retained by said pivot means so as to be rotated and swung about said pivot means;
(f) a tong-like jaw formed in the end portion of this separate wire-like length, said tong-like jaw formed into one-half of a figure eight configuration with radii similar to that in the complimentary jaw;
(g) a hook retaining configuration formed in and at the other end of the separate wire-like length member and adapted to engage and be removably retwined by said stem portion, and
(h) a sponge formed from resilient material of a selected softness and having a reduced intermediate portion configured and sized so as to provide and be gripped when and while the tong-like jaw portions are in a closed and retained condition.

13. A device for scrubbing and/or scratching the back of a user and providing means for manipulation by said user to reach otherwise inaccessible areas of the body, said device including:
(a) a handle portion adapted for grasping by the user;
(b) a wire-like stem portion secured to and extending from said handle portion;
(c) a pivot means provided at a determined distance from said handle and on said wire-like stem portion;
(d) a tong-like jaw formed from the distal end portion of the wire-like stem portion, this tong-like jaw formed into one-half of an ellipse configuration of a selected size;
(e) a separate wire-like length member having a mid-portion adapted to engage and be retained by said pivot means so as to be rotated and swung about said pivot means;
(f) a tong-like jaw formed in the end portion of this separate wire-like length, said tong-like jaw formed into one-half of an ellipse configuration with a size similar to that in the complimentary jaw;
(g) a hook retaining configuration formed in and at the other end of the separate wire-like length member and adapted to engage and be removably retained by said stem portion, and
(h) a sponge formed from resilient material of a selected softness and having a reduced intermediate portion configured and sized so as to provide and be gripped when and while the tong-like jaw portions are in a closed and retained condition.

* * * * *